US008689594B2

(12) United States Patent
Yanar et al.

(10) Patent No.: US 8,689,594 B2
(45) Date of Patent: Apr. 8, 2014

(54) ELECTRICAL CYLINDER LOCK

(76) Inventors: Tuncay Erhan Yanar, Istanbul (TR); Omer Dogan, Istanbul (TR)

( * ) Notice: Subject to any disclaimer, the term of this patent is extended or adjusted under 35 U.S.C. 154(b) by 0 days.

(21) Appl. No.: 13/634,510

(22) PCT Filed: Mar. 10, 2011

(86) PCT No.: PCT/EP2011/053652

§ 371 (c)(1),
(2), (4) Date: Sep. 28, 2012

(87) PCT Pub. No.: WO2011/110647

PCT Pub. Date: Sep. 15, 2011

(65) Prior Publication Data

US 2013/0192318 A1 Aug. 1, 2013

(30) Foreign Application Priority Data

Mar. 12, 2010 (EP) ..... 10156437

(51) Int. Cl.
*E05B 47/00* (2006.01)
*E05B 13/10* (2006.01)

(52) U.S. Cl.
USPC ..... 70/279.1; 70/222; 70/278.6; 70/278.7

(58) Field of Classification Search
USPC ..... 70/221–223, 277, 278.1, 278.6, 278.7, 70/279.1, 280, 281, 282
See application file for complete search history.

(56) References Cited

U.S. PATENT DOCUMENTS

| | | | | |
|---|---|---|---|---|
| 3,748,878 | A * | 7/1973 | Balzano et al. | 70/218 |
| 6,158,259 | A * | 12/2000 | Schmitz et al. | 70/276 |
| 6,865,916 | B2 * | 3/2005 | Goldman | 70/472 |
| 7,231,791 | B2 * | 6/2007 | Sakai | 70/277 |
| 7,591,160 | B2 * | 9/2009 | Keller | 70/277 |
| 8,336,347 | B2 * | 12/2012 | Joukov | 70/277 |
| 8,375,753 | B2 * | 2/2013 | Goldman | 70/277 |
| 2003/0160681 | A1 | 8/2003 | Menard | |
| 2004/0250578 | A1 | 12/2004 | Sakai | |
| 2005/0044909 | A1 * | 3/2005 | Lange | 70/278.1 |
| 2008/0028808 | A1 * | 2/2008 | Keller | 70/277 |
| 2008/0296912 | A1 | 12/2008 | Whitner | |
| 2009/0308117 | A1 * | 12/2009 | Goldman | 70/277 |
| 2010/0011822 | A1 * | 1/2010 | Imedio Ocana | 70/278.7 |
| 2010/0154494 | A1 * | 6/2010 | Sakai et al. | 70/277 |

FOREIGN PATENT DOCUMENTS

| | | | |
|---|---|---|---|
| DE | 102004021704 | B3 | 12/2005 |
| EP | 1997983 | A1 | 12/2008 |
| EP | 2096239 | A1 | 9/2009 |
| WO | WO 9641486 | A1 | 12/1996 |
| WO | WO 03042475 | A1 | 5/2003 |

* cited by examiner

*Primary Examiner* — Christopher Boswell

(74) *Attorney, Agent, or Firm* — Epstein Drangel LLP; Robert L. Epstein

(57) ABSTRACT

An electrical lock system comprises an electric motor, a remote control unit for authenticating authorized users prior to granting permission and communicating such information to a motor (5) driver circuitry wherein said motor (5) is built-in in a doorknob whose axis of rotation is arranged coaxial to said cylinder's longitudinal axis such that said motor's shaft extend along a cylinder adaptor region integrating said doorknob to said lock cylinder. Said adaptor portion is coupled to a mechanical bloc connecting said adaptor region to a battery bloc and to said motor (5) through an intermediary body integral to said doorknob enclosing said motor (5) and gear mechanism.

8 Claims, 2 Drawing Sheets

ELECTRICAL CYLINDER LOCK

TECHNICAL FIELD OF THE INVENTION

The present invention relates to an electrical lock mechanism suitable for instantly substituting an existing lock mechanism by way of easy mounting.

BACKGROUND OF THE INVENTION

Electrical lock mechanisms are widely used overall the world and are especially convenient for multiple access control systems. Although requiring an electrical power source and wiring, electrical locks for individual home users are also available in the market. Such locks can be modified to be incorporating a power source without requiring further wiring for home users. Those are however still deficient in that it is not always possible to replace an existing conventional cylinder lock mechanism with an electrical lock by way of easy and instant mounting.

Therefore a electrical lock which is easily adaptable to replace an existing conventional lock mechanism is of need in the market. The lock mechanism according to the present invention can be mounted as fast as possible to the extent that it practically requires the same amount of work and time compared to replacing said existing conventional cylinder mechanism with another conventional cylinder mechanism.

The lock mechanism according to the present invention is designed to be mounted on almost every door previously comprising a conventional cylinder lock mechanism.

The mechanism is advantageous in that the driver circuitry according to the present invention is automatically effecting locking and unlocking by way of rotation of the motor (5) shaft. A prior art document relevant in the field being US2004250578 publication, the latter although comprising a rotary means, does not provide locking and unlocking of the mechanism, which is therefore not functionally comparable to the rotary means of the present invention.

The closest prior art documents with regard to the subject-matter of claim 1 can be defined as the following prior art items D1 to D3, respectively WO 96/41486, US 2003/160681 and EP 1 997 983. D1 discloses an electronic and electromechanical device having components mounted within the void or hollow portions of existing door locking apparatus, such as within the hollow interior doorknob. A keyless locking mechanism is controlled by a remote handheld device. D2 discloses a cylindrical door lock having a latching spindle and an opening spindle which are concentrically oriented, and a wireless communication system to transmit signals indicating the relative positions of the latching spindle and the opening spindle. A communication device is provided to communicate over a two-way wireless network with an electrically controlled actuator. D3 discloses a dummy lock barrel shaped to appear as a conventional lock cylinder and which can conventionally be fixed to the door around the bridge-like region below a vertical gap in between the two cylinder halves.

OBJECTS OF THE INVENTION

The primary object of the present invention is to provide an electrical lock mechanism adapted to replace an existing conventional lock cylinder mechanism easily and instantly.

Another object of the present invention is to provide an electrical lock assembly which is adapted to be mounted on every door previously comprising a conventional cylinder lock mechanism and without further mechanical work on the door.

In particular, the object is to provide an electrical lock assembly which can be mounted without e.g. drilling or otherwise modifying the structure of a door equipped with a conventional cylinder lock and in the absence of additional fastening means.

Another object of the present invention is to provide an electrical lock assembly which does not require additional power source, such as feed from mains supply.

SUMMARY OF THE INVENTION

The present invention proposes a lock barrel shaped as a conventional lock cylinder and which can conventionally be fixed to the door around the bridge-like region below a vertical gap in between the two cylinder halves. A doorknob shaped driving assembly set coaxial to said cylinder's longitudinal axis is arranged to control locking and unlocking of the driving pawl in between two cylinder halves so as to actuate post-barrel lock mechanisms in a conventional manner. A further control unit is adapted to communicate with said driving assembly to actuate the driver means in the event that an authorization is granted. Said control unit comprises a biometric sensor for granting access and both said driving means and said control unit are powered by embedded batteries.

The electrical lock system comprises an electric motor (5) and a remote control unit for authenticating authorized users prior to granting permission and communicating such information to a motor (5) driver circuitry. A lock cylinder, typically having two half-housings divided by a notch in which a rotatably arranged pawl is driven to actuate post-barrel lock mechanisms is coupled to the electric motor. The motor (5) is built-in in a doorknob integrally formed with said lock cylinder. The axis of rotation of said motor (5) is arranged coaxial to the cylinder's longitudinal axis such that the motor's shaft extends along the half housing between the doorknob and the notch and along a cylinder adaptor region integrating the doorknob to the lock cylinder in order for said motor's shaft to be coupled to the pawl.

BRIEF DESCRIPTION OF THE FIGURES

Accompanying drawings are given solely for the purpose of exemplifying a biometric lock assembly whose advantages over prior art were outlined above and will be explained in detail hereinafter.

DETAILED DESCRIPTION OF THE INVENTION

Figure 1:
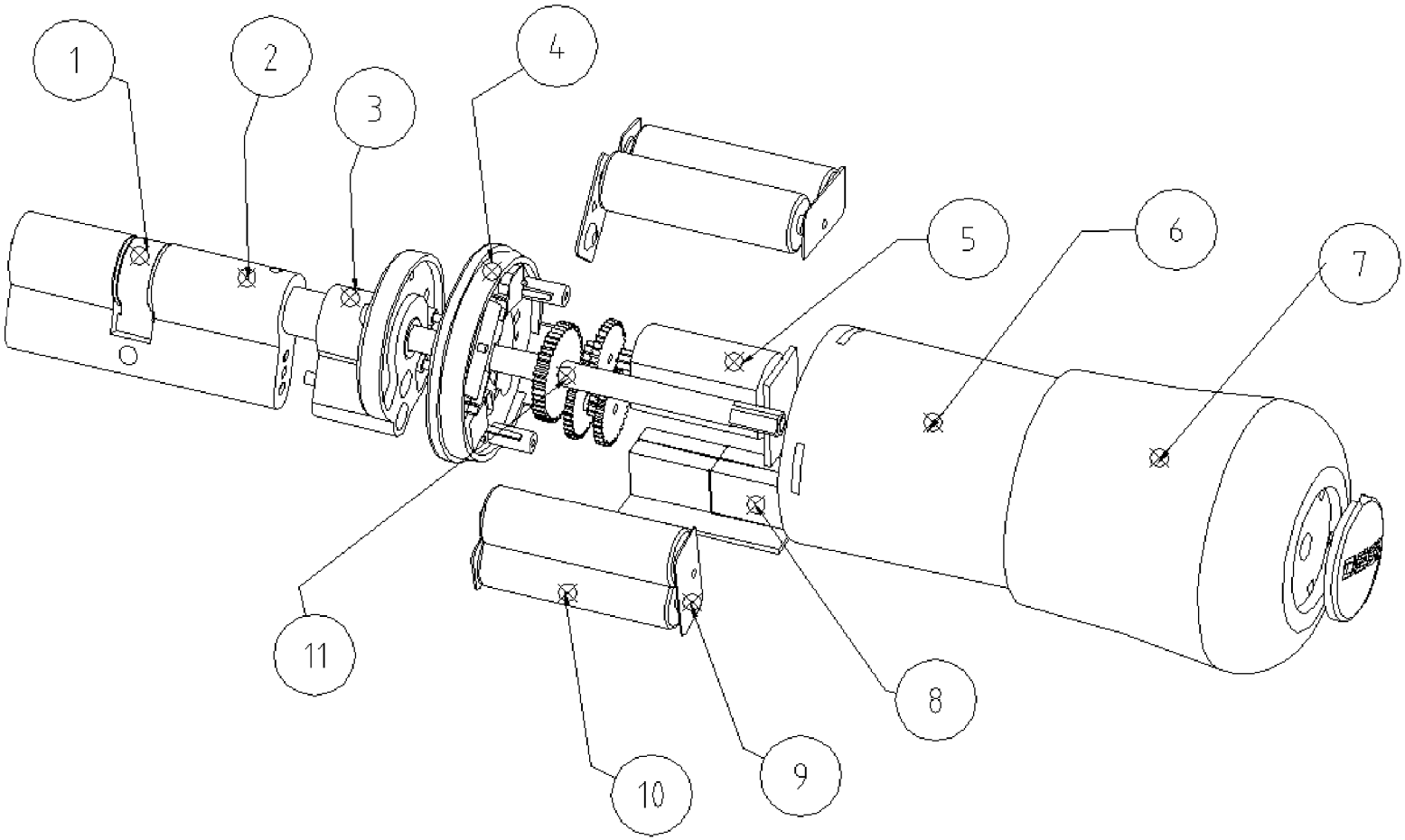
FIG. 1 demonstrates an exploded perspective side view of a cylinder lock and driver mechanism according to the present invention.
Figure 2:
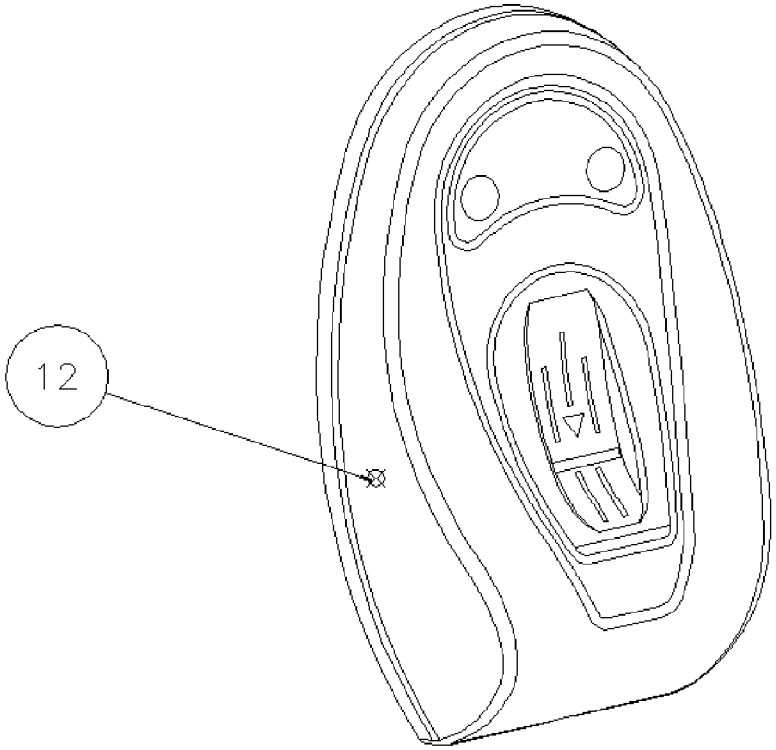
FIG. 2 demonstrates the control unit in wireless communication with said driver mechanism according to the present invention.

Referring now to the figures outlined above, the electrical lock assembly comprises a pawl (1) arranged between two half-cylinders for operating post-cylinder locking mechanisms. The cylinder lock (2) is identical to a conventional pin tumbler cylinder lock in shape. It typically comprises a longitudinally extending cylindrical portion in the form of two divisions or cylindrical half-housings and a flat portion extending parallel to the upper cylindrical portion with a notch in the middle, through which said pawl is rotatably movable between said divisions, to operate post barrel lock mechanisms.

The lock assembly according to the present invention can easily and instantly be mounted to replace an existing conventional lock cylinder. To this end, steps taken in order for mounting the electrical lock assembly of the present invention are similar to those for mounting a conventional cylinder lock without requiring any further step. Therefore the electrical lock can easily be mounted by way of fixing the mounting screw at the screw hole located on said bridge-like portion.

The electrical lock with a lock cylinder (2) having a conventional lock cylinder's appearance in shape is adapted to be integral to a driving unit provided within a doorknob (7). Said doorknob (7) incorporates said driving unit for effecting locking and unlocking of the post barrel lock mechanisms by way of rotating said pawl (1). The motor (5) is powered by means of built-in e.g. AA size alkaline batteries (10), also embedded within said doorknob (7). The motor (5) is typically a small brushed or brushless DC motor in which speed and torque control can easily be done by adjusting the voltage and high operating torque with a reduced speed can be achieved in order for unlocking the door. Typical drive circuits according to the basic control principle above are available in the market and mention of further details of motor (5) control circuitry is deemed needless.

The motor (5) is driven to operate and unlock the lock only when a user is granted authorization, i.e. in the case of a biometric lock only when a pre-registered fingerprint pattern is authenticated by a remote module and information of authorization status is communicated to said drive circuitry. As the essential approach adopted by the preferred embodiment of the present invention offers simplicity and allowability of easy replacement of an existing cylinder lock in a manner as quickest as possible by an electrical cylinder lock, use of a remote authentication module in wireless communication with the drive circuitry of the motor (5) assembly set within a doorknob which is integral to a cylinder lock (2) identical to a tumbler pin conventional cylinder lock in geometric terms provides an electrical cylinder lock which can in no time be mounted to be ready for operation.

The fingerprint reader module (12) according to the present invention may comprise sensors of any type. All fingerprint sensors generate a digital picture of the finger surface. The picture normally has a pixel resolution of 500 dpi. Sensors may be of any type of capacitive, optical or thermal sensors. Various products having different characteristics in terms of image quality, indoor-outdoor use, personal-public use, size, cost, sensitivity against vandalism and electrostatic discharge sensitivity are available in the market.

In brief, the fingerprint reader module (12) communicating with the doorknob (7) according to the present invention may be of any suitable type as long as it is convenient for achieving the general object of the invention, i.e. providing fingerprint authentication and establishing wireless communication with the drive mechanism. Lithium powered modules are also available in the market. Such modules are suitable for storing a plurality of pre-registered fingerprint patterns to substantiate identities thereof.

Although not being a distinguishing feature, the reader module (12) and the doorknob (7) unit according to the present invention communicate with each other using RF to grant permission for uniquely identified fingerprint patterns. The two-way encoded communication and hardware enabling such communication is not of interest as far as the present invention is concerned.

Further referring to FIG. 1, the lock cylinder (2) is adjoined to said driving unit, i.e. the doorknob (7) through an adaptor portion (3), the latter being coupled to a mechanical bloc (4) connecting said adaptor region (3) to said battery bloc (10) and to said motor. Said doorknob (7) is integral to an intermediary body (6) enclosing said motor (5) and gear mechanism. Said battery bloc (10) is communicating with said motor (5) and an electronic control unit (8) through a conductive plate (9). The motor (5) conventionally drives a gear mechanism (11) through its shaft.

The cross-section taken on a point along the longitudinal axis of said lock cylinder (2) is identical to a cross-section of said lock adaptor (3) taken on the same axis. The cylinder adaptor portion (3) is merely designed to integrate said doorknob (7), which comprises means for communicating with said remote module and means for driving said motor.

Integration of a doorknob (7) having a built-in motor (5) directly into a lock cylinder which is identical to a conventional pin tumbler cylinder lock in shape by means of said adaptor region (3) provides a motor-cylinder assembly which can easily and quickly replace an existing cylinder lock mechanism.

The motor (5) is advantageous in that the driver circuitry according to the present invention is automatically effecting locking and unlocking by way of rotation of the motor (5) shaft.

According to the present invention a user may unlock the mechanism from outside both through conventional ways, i.e. by using a proper key or through biometric or other authentication methods as discussed earlier as a matter of choice. Further, due to the fact that said mechanical bloc's (4) gear mechanism is coupled to both the motor (5) and to the main shaft being coaxial with the doorknob (7) longitudinal axis, a user may operate the lock mechanism from inside his/her house by rotating said doorknob (7) mechanically without activating the motor, i.e. when the motor (5) is not functioning. This allows a resident to leave his/her house in case of an emergency and when the electrical components of the lock are malfunctioning.

When a user rotates said doorknob (7) mechanically, the motor's (5) shaft being also rotated due to the configuration of the gear mechanism, the latter will sense the direction of the rotation due to the induced voltage and rotates the main shaft itself after the user started rotation. The motor (5) is therefore responsive to the rotation of the main shaft such that it is activated thereupon.

Therefore the gear mechanism in which the motor's (5) shaft is coupled to the main shaft provides the effect that in case of malfunction of electrical components of the lock, mechanical unlocking from inside in case of emergency is enabled and the motor (5) steps in to rotate the main shaft when a user started rotation.

Said gear mechanism is an eccentric gear comprising a stationary gear wheel and an eccentric gear wheel where a first orbiting cog wheel coupled to the main shaft engages with a secondary cog wheel in association with said motor's shaft. The electronic control unit (8) may comprise conventional control circuitry for sensing the direction of rotation and driving said motor (5) in response thereto as is known to the craftsman in the art.

Further, the fact that said main shaft is eccentric to the shaft of the motor (5) provides mechanical unlocking by way of rotating said doorknob (7) which would not be possible or would require a very complex design if said two shafts were coaxial.

The invention claimed is:

1. An electrical lock system comprising an electric motor, a remote control unit (12) for authenticating authorized users prior to granting permission and communicating such information to a motor (5) driver circuitry upon which said motor (5) automatically effects locking and unlocking by way of rotation of a shaft, said system further comprising a lock cylinder (2), wherein said motor (5) is built-in in a doorknob (7) whose axis of rotation is arranged coaxial to said cylinder's (2) longitudinal axis such that said motor's shaft extend along a cylinder adaptor region (3) integrating said doorknob (7) to said lock cylinder (11), said cylinder adaptor region (3) is coupled to a mechanical bloc (4) connecting said cylinder adaptor region (3) to a battery bloc (10) and to said motor (5) through an intermediary body (6) integral to said doorknob (7) enclosing said motor (5) and a gear mechanism, said gear mechanism couples said motor's (5) shaft to a shaft being coaxial with the doorknob (7) longitudinal axis, said main shaft is eccentric to said motor's (5) shaft, shaft of said cylinder (2) is directly rotatable by said motor (3) through said gear mechanism while said doorknob (7) maintains its stationary position.

2. An electrical lock system as set forth in claim 1 wherein said gear mechanism is an eccentric gear comprising a stationary gear wheel and an eccentric gear wheel where a first orbiting cog wheel coupled to the main shaft engages with a secondary cog wheel in association with said motor's (5) shaft.

3. An electrical lock system as set forth in claim 1 or 2 wherein said motor (5) is responsive to the rotation of the main shaft such that it is automatically actuable thereupon.

4. An electrical lock system as set forth in claim 1 wherein both said cylinder (2) is equipped with a key slot for effecting unlocking by means of a key operable from the opposite side of said doorknob (7).

5. An electrical lock system as set forth in claim 4 wherein said battery bloc (10) is communicating with said motor (5) and an electronic control unit (8) through a conductive plate (9) enclosed in said intermediary body (6) integral to said doorknob (7).

6. An electrical lock system as set forth in claim 5 wherein said remote control unit (12) is a fingerprint reader module.

7. An electrical lock system as set forth in claim 6 wherein said remote control (12) unit is adapted to establish wireless communication with said motor (5) driver circuitry.

8. An electrical lock system as set forth in claim 1 wherein said lock cylinder (2) comprises a longitudinally extending cylindrical portion in the form of two divisions or cylindrical half-housings such that a first division of said lock cylinder (2) is mechanically operable without activating the motor (5).

* * * * *